US012595037B1

(12) United States Patent
Dharmadhikari et al.

(10) Patent No.: US 12,595,037 B1
(45) Date of Patent: Apr. 7, 2026

(54) MARINE DRIVE ASSEMBLY HAVING EXTERIOR MOUNTED HEAT EXCHANGER

(71) Applicant: Brunswick Corporation, Mettawa, IL (US)

(72) Inventors: Chetan Avinash Dharmadhikari, Brookfield, WI (US); John A. Groeschel, Theresa, WI (US); George D. Idzikowski, Lomira, WI (US)

(73) Assignee: Brunswick Corporation, Mettawa, IL (US)

( * ) Notice: Subject to any disclaimer, the term of this patent is extended or adjusted under 35 U.S.C. 154(b) by 411 days.

(21) Appl. No.: 18/210,897

(22) Filed: Jun. 16, 2023

(51) Int. Cl.
*B63H 21/38* (2006.01)

(52) U.S. Cl.
CPC ..... *B63H 21/383* (2013.01)

(58) Field of Classification Search
CPC ..... B63H 21/383; B63H 20/22; F01P 3/20; F01P 3/203; F01P 3/207; F01P 2050/10
See application file for complete search history.

(56) References Cited

U.S. PATENT DOCUMENTS

| | | | | |
|---|---|---|---|---|
| 4,600,395 | A | 7/1986 | Pichl | |
| 5,214,975 | A | 6/1993 | Zalewski | |
| 5,746,270 | A | 5/1998 | Schroeder et al. | |
| 6,273,771 | B1 | 8/2001 | Buckley et al. | |
| 6,544,085 | B1 | 4/2003 | Menard et al. | |
| 6,748,906 | B1 | 6/2004 | White et al. | |
| 7,094,118 | B1 * | 8/2006 | Phillips | F01P 3/207 440/88 HE |
| 7,100,584 | B1 | 9/2006 | Bruestle et al. | |
| 7,329,162 | B1 | 2/2008 | Caldwell et al. | |
| 7,347,753 | B1 | 3/2008 | Caldwell et al. | |
| 8,864,538 | B1 | 10/2014 | Arbuckle et al. | |
| 9,334,034 | B1 | 5/2016 | Waldvogel et al. | |
| 9,446,828 | B1 * | 9/2016 | Groeschel | B63H 20/06 |
| 10,800,502 | B1 | 10/2020 | Alby et al. | |
| 11,364,987 | B1 | 6/2022 | Foulkes et al. | |
| 2010/0084111 | A1 | 4/2010 | Jaeger et al. | |

OTHER PUBLICATIONS

Mercury Marine, NTN Overview & CVJ Technology, retrieved from www.ntnamericas.com. Dated Aug. 7, 2018.

* cited by examiner

*Primary Examiner* — Andrew Polay
(74) *Attorney, Agent, or Firm* — Andrus Intellectual Property Law, LLP

(57) ABSTRACT

A marine drive assembly is configured for propelling a marine vessel in a body of water. The marine drive assembly may include a drive unit having a propulsor for generating a thrust force in the body of water, a mounting bracket for mounting the drive unit to the marine vessel, the mounting bracket having an exterior facing portion outside the marine vessel and an interior facing portion inside the marine vessel, and a heat exchanger configured to exchange heat between water from the body of water and a cooling fluid for cooling a component of the marine drive assembly, wherein the heat exchanger is coupled to the exterior of the mounting bracket.

19 Claims, 5 Drawing Sheets

MARINE DRIVE ASSEMBLY HAVING EXTERIOR MOUNTED HEAT EXCHANGER

FIELD

The present disclosure relates to marine drive assemblies, and more particularly to marine drive assemblies having a heat exchanger for cooling components thereof.

BACKGROUND

The following U.S. Patents are incorporated herein by reference in entirety.

U.S. Pat. No. 5,746,270 discloses a heat exchanger assembly provided for a marine propulsion system having a closed loop cooling system. The heat exchanger body encloses a series of tubes carrying sea water which removes heat from the engine coolant. The heat exchanger includes an integrally connected top tank. A single venting orifice is provided into the top tank from the heat exchanger body. A heat exchanger coolant outlet is in direct fluid communication with both a system bypass and the coolant in the top tank. An auxiliary inlet for coolant from the top tank is located in the heat exchanger coolant outlet downstream of the bypass inlet, thereby promoting the ability of the system to draw coolant through the top tank rather than the bypass.

U.S. Pat. No. 6,748,906 discloses a heat exchanger for a marine internal combustion engine disposed between first and sides of a V-shaped engine configuration. A plurality of tubes and related structure are disposed within a cavity formed as an integral part of an air intake manifold of the engine. A first cooling fluid, such as ethylene glycol, is circulated in thermal communication with outer surfaces of the plurality of tubes within the heat exchanger and a second cooling fluid, such as lake or sea water, is circulated through the internal passages of the plurality of tubes. A conduit is provided within an end portion of the heat exchanger to remove heat from a lubricant, such as oil, of the internal combustion engine.

U.S. Pat. No. 7,100,584 discloses an engine control system configured to determine a desired temperature range of air flowing into an intake manifold of the engine as a function of an operating characteristic, such as the load on the engine or the operating speed of the engine. A bypass conduit is provided in parallel with a heat exchanger, wherein both the bypass conduit and the heat exchanger are connected to an outlet of a compressor to direct air from the compressor to an intake manifold along the parallel paths. By manipulating an air valve in the bypass conduit, an engine control unit can regulate the temperature at an inlet of the intake manifold. A desired temperature is selected from a matrix of stored values as a function of the load on the engine and the engine operating speed.

U.S. Pat. No. 7,329,162 discloses a cooling system for a marine vessel which is configured to allow all cooling water to flow out of the cooling circuit naturally and under the influence of gravity when the marine vessel is removed from the body of water. All conduits of the cooling circuit are sloped downwardly and rearwardly from within the marine vessel to an opening through its transom. Traps are avoided so that residual water is not retained within locations of the cooling system after the natural draining process is complete. The opening through the transom of the marine vessel is at or below all conduits of the cooling system in order to facilitate the natural draining of the cooling system under the influence of gravity and without the need for operator intervention.

U.S. Pat. No. 8,864,538 discloses systems and methods for cooling a marine propulsion system on a marine vessel. A lift pump pumps raw cooling water from a body of water in which the marine vessel is situated. The lift pump pumps the raw cooling water through an open cooling circuit from an upstream inlet for receiving the raw cooling water to a downstream outlet for discharging the cooling water back to the body of water. A control circuit controls operation of the lift pump. At least one sensing device indicates whether the lift pump is connected to the body of water. The sensing device is in communication with the control circuit. The control circuit prevents operation of the lift pump when the sensing device indicates that the lift pump is not connected to the body of water.

U.S. Pat. No. 9,334,034 discloses a system for combined control of steering and trim of a marine engine unit. The system includes a steering apparatus generating steering signals, a trim control generating trim signals, an electronic unit receiving steering trim and cylinder position signals and sending output signals. Port and starboard hydraulic cylinders are connected to port and starboard joints to provide movement of the engine unit. The port and starboard joints enable movement of the engine unit vertically and horizontally when the port and starboard hydraulic cylinders are extended and retracted to provide a full range of steering and trim movement of an engine unit.

U.S. Pat. No. 9,446,828 discloses an apparatus for mounting a marine drive to a hull of a marine vessel. An outer clamping plate faces an outside surface of the hull and an inner clamping plate faces an opposing inside surface of the hull. A marine drive housing extends through the hull. The marine drive housing is held in place with respect to the hull by at least one vibration dampening sealing member which is disposed between the inner and outer clamping plates. A first connector clamps the outer clamping plate to the outside surface of the hull and a second connector clamps the inner clamping plate to the outer clamping plate. The inner and outer clamping plates are held at a fixed distance from each other so that a consistent compression force is applied to the vibration dampening sealing member.

U.S. Pat. No. 10,800,502 discloses an outboard motor having a powerhead which causes rotation of a driveshaft, a steering housing located below the powerhead, wherein the driveshaft extends from the powerhead into the steering housing; and a lower gearcase located below the steering housing and supporting a propulsor shaft which is coupled to the driveshaft so that rotation of the driveshaft causes rotation of the propulsor shaft. The lower gearcase is steerable about a steering axis with respect to the steering housing and powerhead.

U.S. Pat. Pub. No. 20100084111 discloses a liquid to liquid heat exchanger for a marine engine cooling system having a tube bundle within a non-metallic shell, provides a thermostat within an integral portion of the shell, uses bolts that both push and pull respective end caps when rotated, and in one embodiment provides an integral deaeration reservoir to remove entrained gases from a liquid of a closed cooling system.

SUMMARY

This Summary is provided to introduce a selection of concepts which are further described below in the Detailed Description. This Summary is not intended to identify key or essential features of the claimed subject matter, nor is it intended to be used as an aid in limiting the scope of the claimed subject matter.

An embodiment of a marine drive assembly may be configured for propelling a marine vessel in a body of water. The marine drive assembly may include a drive unit having a propulsor for generating a thrust force in the body of water, a mounting bracket for mounting the drive unit to the marine vessel, the mounting bracket having an exterior facing portion outside the marine vessel and an interior facing portion inside the marine vessel, and a heat exchanger configured to exchange heat between water from the body of water and a cooling fluid for cooling a component of the marine drive assembly, wherein the heat exchanger is coupled to the exterior of the mounting bracket.

In some embodiments, the heat exchanger may be located at least partially outside of the marine vessel. The drive unit may include a stern drive which extends through the mounting bracket. The heat exchanger may be located above the drive unit. The heat exchanger may be configured to remain above the body of water during operation of the marine vessel. Additionally or alternatively, the heat exchanger may be configured to drain the water back to the body of water automatically by gravity.

In some embodiments, the mounting bracket may include a gimbal housing and wherein the heat exchanger is mounted in the gimbal housing. In such an embodiment, the drive unit may include a driveshaft assembly which extends through the gimbal housing, and wherein the heat exchanger is located above the driveshaft assembly. The marine drive assembly may further include a cooling water pump which pumps the water from the body of water to the heat exchanger, and the cooling water pump may be coupled to the marine drive assembly outside of the marine vessel. Additionally or alternatively, the cooling water pump may be coupled to the mounting bracket.

In some embodiments, the marine drive assembly has a center of gravity and wherein the heat exchanger is located vertically directly above the center of gravity. The marine drive assembly may further include a vibration isolator for coupling the mounting bracket to the marine vessel. The heat exchanger may be accessible from the exterior of the mounting bracket for servicing. The heat exchanger may be removable from the mounting bracket. Additionally or alternatively, the heat exchanger comprises an inlet for receiving the water from the body of water and an outlet for discharging the water back to the body of water, wherein the inlet and outlet are both located outside of the marine vessel.

Some examples of a marine vessel may include a hull and a marine drive assembly for propelling the marine vessel in a body of water. The marine drive assembly may include a drive unit having a propulsor for generating a thrust force in the body of water, a mounting bracket which mounts the drive unit to the hull, the mounting bracket having an exterior facing portion outside the marine vessel and an interior facing portion inside the marine vessel, and a heat exchanger configured to exchange heat between water from the body of water and a cooling fluid for cooling a component of the marine drive assembly, wherein the heat exchanger is coupled to the exterior of the mounting bracket.

In some embodiments, the drive unit may comprise a stern drive which extends through the mounting bracket. The heat exchanger may be located above the drive unit. The heat exchanger may be configured to remain above the body of water during operation of the marine vessel. Additionally or alternatively, the heat exchanger may be configured to drain the water back to the body of water automatically by gravity.

BRIEF DESCRIPTION OF THE DRAWINGS

The present disclosure includes the following figures.

DETAILED DESCRIPTION OF THE DRAWINGS

Figure 1:
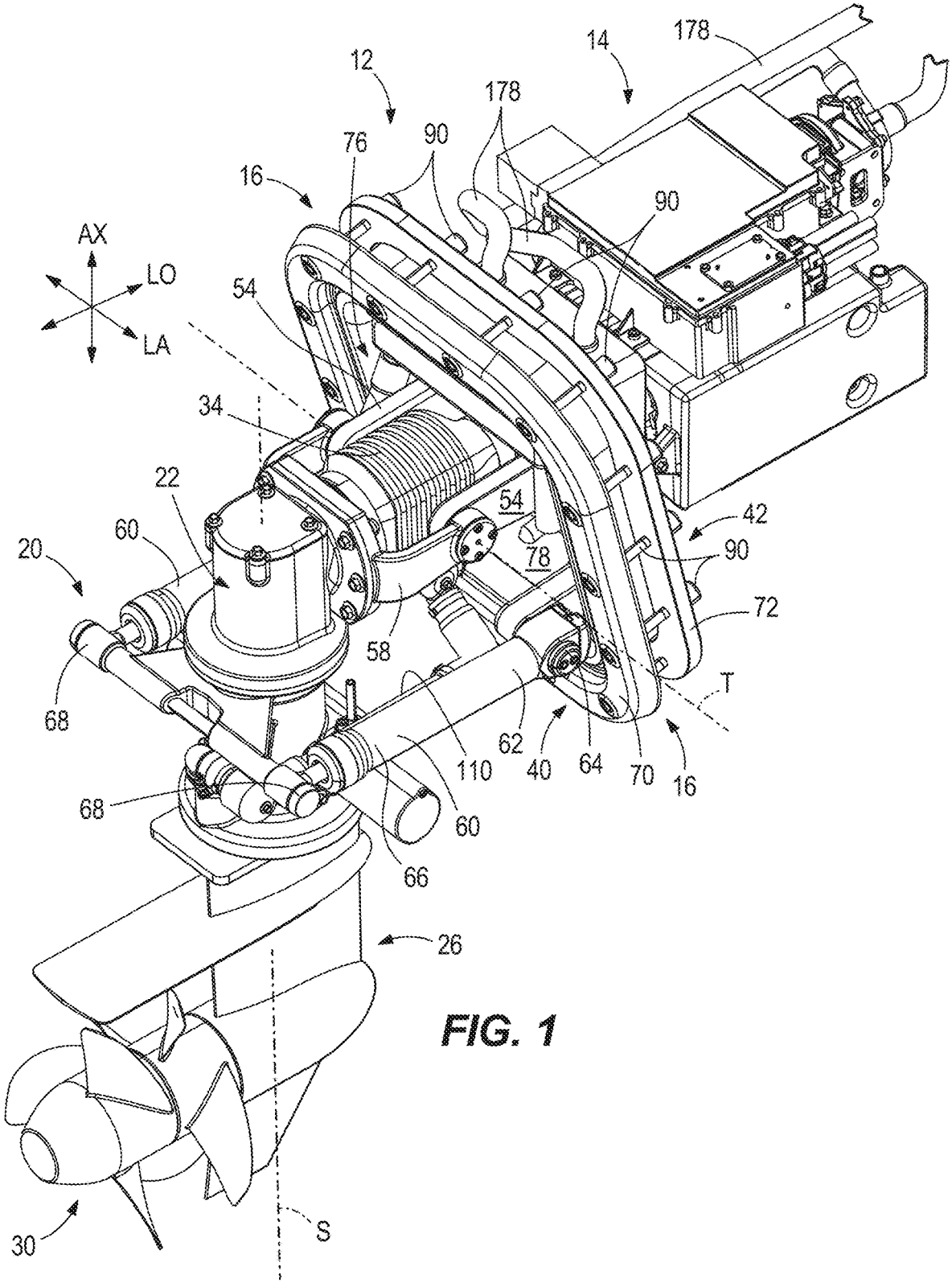
FIG. 1 is a starboard side perspective view of a marine drive assembly according to the present disclosure.
Figure 2:
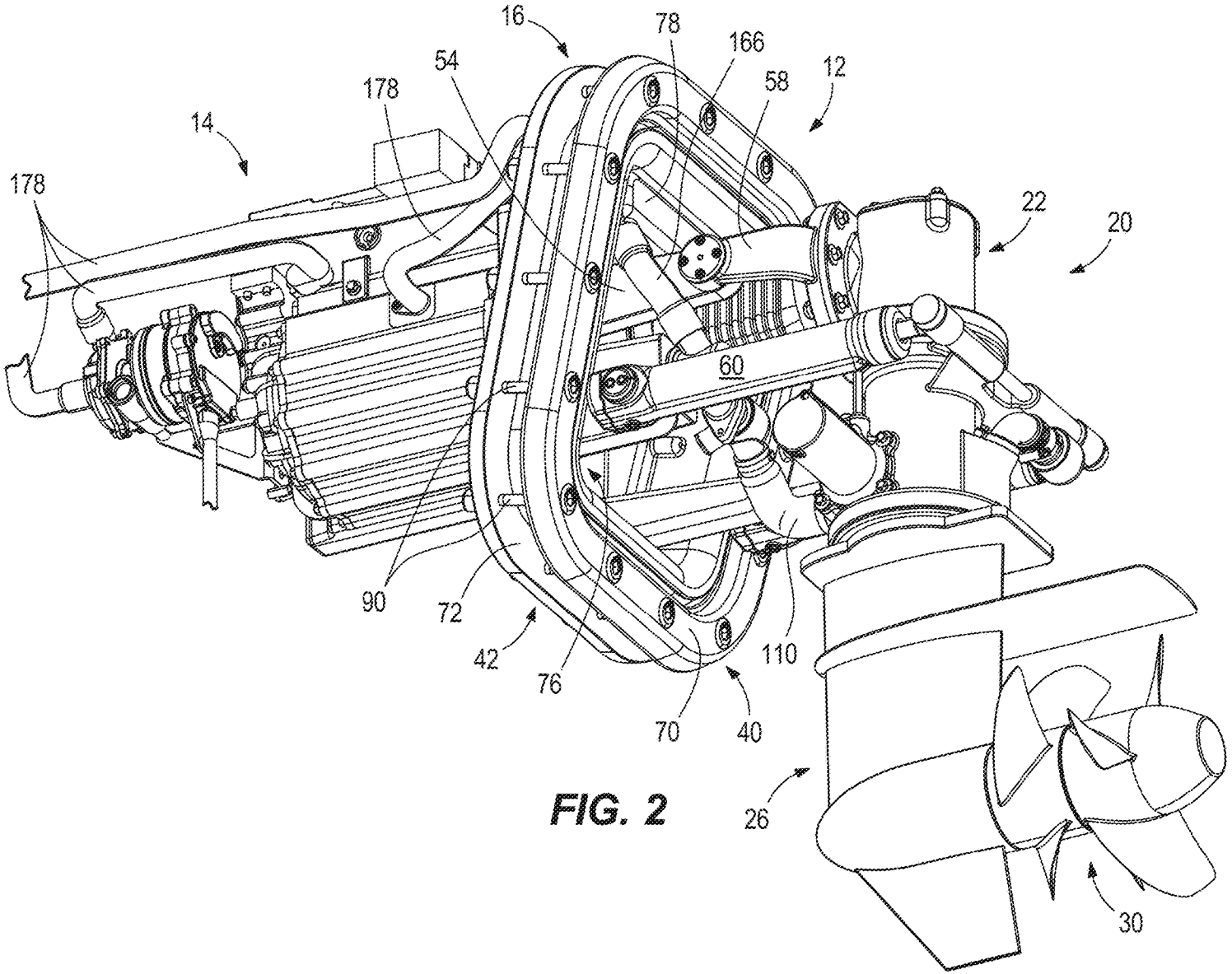
FIG. 2 is a port side perspective view of the marine drive assembly of FIG. 1.

FIGS. 1 and 2 depict a marine drive assembly 12 for propelling a marine vessel (not shown) in a body of water. In the illustrated embodiment, the marine drive assembly 12 extends from top to bottom in an axial direction AX, from front to back in a longitudinal direction LO which is perpendicular to the axial direction AX, and from side to opposite side in a lateral direction LA which is perpendicular to the axial direction AX and perpendicular to the longitudinal direction LO. The marine drive assembly 12 has a mounting bracket 16, which supports the marine drive assembly 12 on the hull (e.g., the transom) of a marine vessel, a motor assembly 14, and a drive unit 20 configured to generate a thrust force in the body of water. In the illustrated embodiments, the drive unit 20 is configured as a stern drive which extends through the mounting bracket 16. The drive unit 20 is coupled to the mounting bracket 16 such that the drive unit 20 is trimmable up and down relative to the mounting bracket 16, including in non-limiting examples wherein the drive unit 20 is raised completely out of the water.

Figure 3:
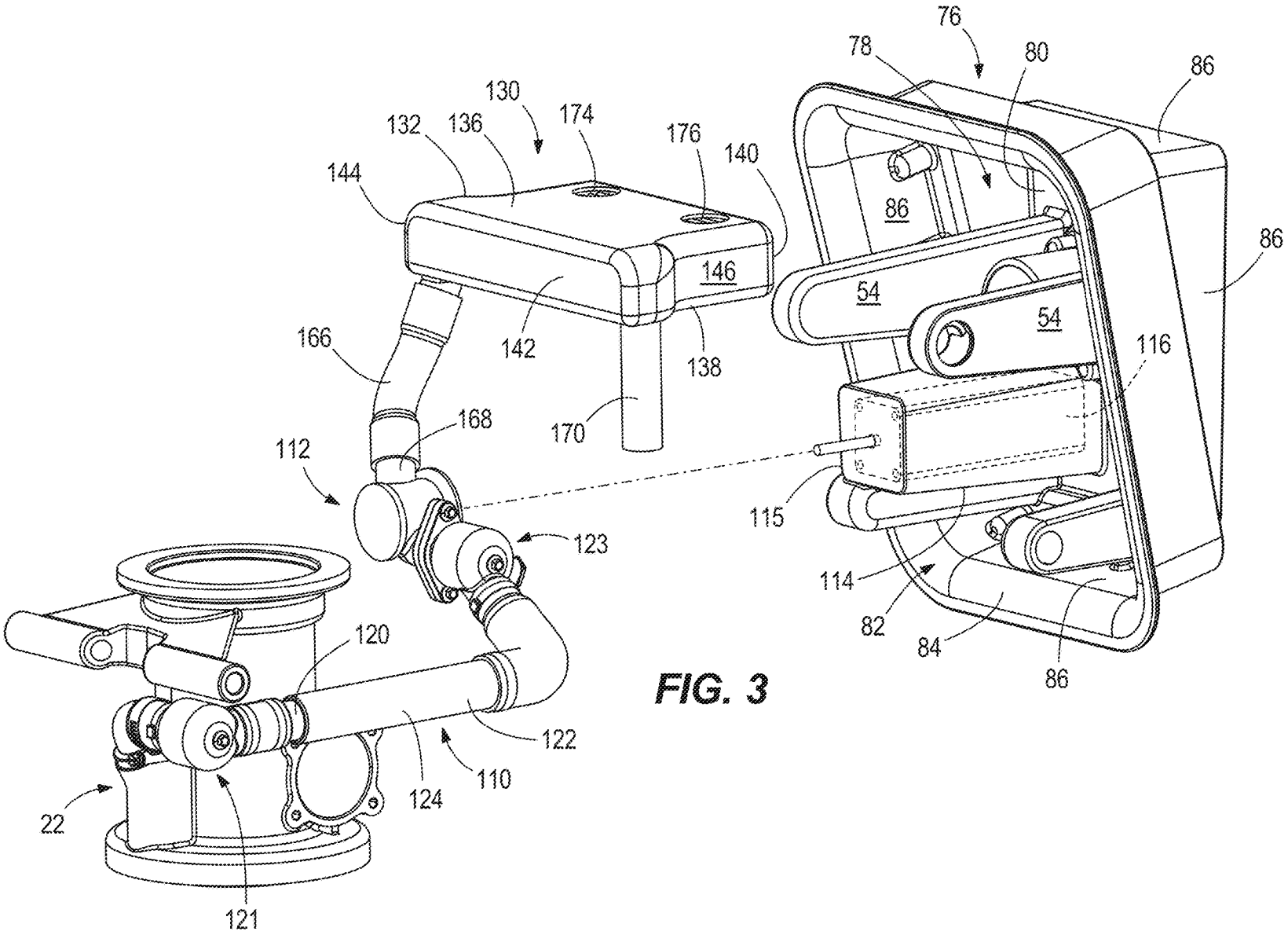
FIG. 3 is an exploded view of the cooling system and gimbal housing from the marine drive assembly of FIG. 2.
Figure 4:
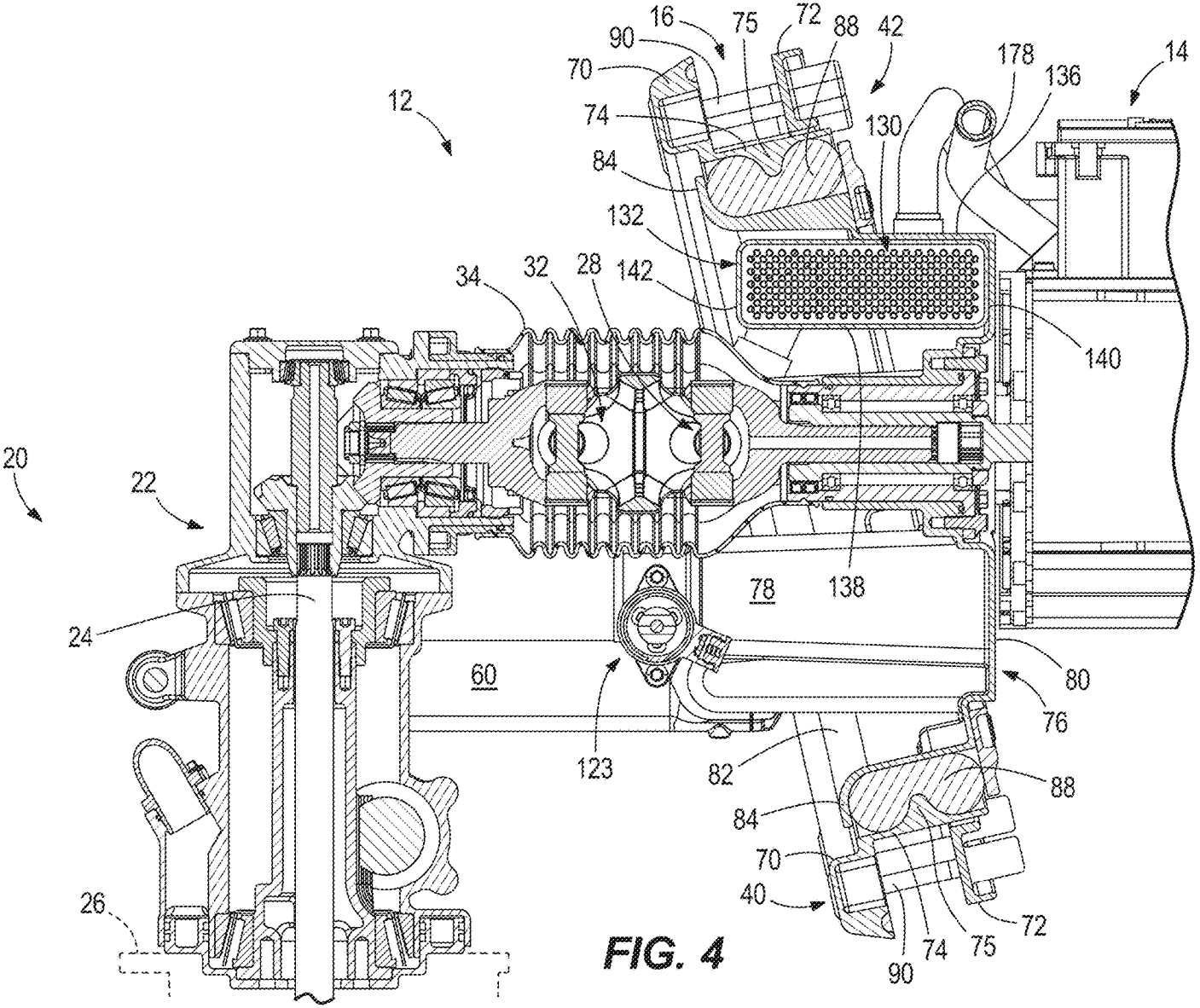
FIG. 4 is a view of section 3-3, taken in FIG. 1

Referring to FIGS. 1, 2, and 4, the mounting bracket 16 extends through a hole (not shown) in the transom of the marine vessel and has an exterior facing portion 40 outside the marine vessel and an interior facing portion 42 inside the marine vessel. The exterior facing portion 40 includes a rigid mounting ring 70 that extends around the perimeter of the hole in the transom on the exterior of the marine vessel, and the interior facing portion 42 includes a fastening ring 72 that extends around the perimeter of the hole in the transom on the interior of the marine vessel. A gimbal housing 76 is supported within the hole in the transom by the mounting ring 70 and is configured to support at least some of the various components of the marine drive assembly 12. As best illustrated in FIGS. 3 and 4, the gimbal housing 76 is recessed into the hull of the marine vessel and includes an interior space 78 defined by a front wall 80, a rear opening 82 defined by an annular flange 84, and side walls 86 that extend longitudinally between the front wall 80 and the annular flange 84. Referring to FIG. 4, the mounting ring 72 includes a flange 74 that extends inward through the hole in the transom (i.e., in a forward longitudinal direction), and a vibration isolator 88 configured as a vibration dampening ring is positioned between the flange 74 and the side walls 86 of the gimbal housing. This may be useful, for example, to reduce the vibrations transmitted to the marine vessel from the drive assembly 12. A locating protrusion 75 formed on the flange 74 engages a groove in the vibration isolator 88 to hold it in the desired position. Fasteners 90 extend through the hull of the marine vessel to couple the mounting ring 70 to the fastening ring 72, thereby coupling the mounting bracket 16 to the marine vessel.

The drive unit 20 has a driveshaft housing 22 and a gearcase housing 26 steerable about a steering axis S relative to the driveshaft housing 22. The driveshaft housing 22 houses a driveshaft 24, and the gearcase housing 26 containing one or more output shaft(s) (e.g., one or more propulsor shafts operatively connected to the driveshaft 24). The output shaft extends from the rear of the gearcase housing 26 and supports one or more propulsors(s) 30 configured to generate thrust in the water for propelling the marine vessel. In the illustrated example, the propulsors 30 are configured as two counter-rotating propellers. However, this is not limiting, and the present disclosure is applicable to other arrangements, including arrangements wherein one or more output shaft(s) are not counter-rotating and/or wherein the output shaft(s) extend from the front of the gearcase housing 26, and/or wherein the propulsor(s) 30 include one or more impellers and/or any other mechanism for generating a propulsive force in the water.

The motor assembly 14 of the marine drive assembly 12 includes a drive shaft assembly 28 that extends through the front wall 80 of the gimbal housing to operatively link the motor of the motor assembly 14 to the driveshaft 24. The drive shaft assembly 28 includes a universal joint 32 (see FIG. 4) which is enclosed in a flexible bellows 34 and couples the motor assembly 14 on the marine vessel to the driveshaft 24 so that operation of the motor assembly 14 causes rotation of the driveshaft 24, which in turn causes rotation of the output shaft and the propulsors 30. The universal joint 32 is also advantageously configured to facilitate trimming of the drive unit 20, for example during periods of non-use. Universal joints or constant velocity (CV) joints facilitating trimming of a marine drive are conventional and well known in the art. Reference is made to U.S. Patent Application No. 63/324,251 which discloses suitable examples, and the entire contents of which are hereby incorporated by reference.

Referring to FIGS. 1 and 2, a pair of rigid mounting arms 54 extends rearwardly from the front wall 80 of the gimbal housing 76 (see also, FIG. 3) and is pivotably coupled to a rigid, U-shaped mounting bracket 58 extending forwardly from the top of the driveshaft housing 22. The pivot joint between the mounting arms 54 and mounting bracket 56 defines a trim axis T about which the drive unit 20 is pivotably trimmable up and down relative to the mounting bracket 16. The type and configuration of mounting bracket 16 can vary from what is shown. In other examples, the mounting bracket 16 may be configured according to the examples disclosed in the above-incorporated U.S. Pat. No. 9,446,828.

With continued reference to FIGS. 1 and 2, rim cylinders 60 are located on opposite sides of the mounting bracket 16. The trim cylinders 60 have a first end 62 pivotably coupled to the gimbal housing 76 at a first pivot joint 64 and an opposite, second end 66 pivotably coupled to the drive unit 20 at a second pivot joint 68. A hydraulic actuator (not shown) is mounted to the gimbal housing 76 on the interior surface of the front wall 80. The hydraulic actuator is hydraulically coupled to the trim cylinders 60 via a least one internal passage through the mounting bracket 16 and the first pivot joint 64, advantageously so that there are no other hydraulic lines located on the exterior of the marine drive assembly 12, or otherwise outside the marine vessel so as to be subjected to wear and/or damage from external elements. The hydraulic actuator is operable to supply hydraulic fluid to the trim cylinders 60 via the noted internal passage to cause extension of the trim cylinders 60 and alternately to cause retraction of the trim cylinders 60. Extension of the trim cylinders 60 pivots (trims) the drive unit 20 upwardly relative to the mounting bracket 16 into a raised position. Retraction of the trim cylinders 60 pivots (trims) the drive unit 20 downwardly relative to the mounting bracket 16 into a lowered position. The hydraulic actuator is conventional and known in the art. Suitable examples are disclosed in the above-incorporated U.S. Pat. No. 9,334,034.

Referring to FIGS. 1-3, the marine drive assembly 12 has a cooling system for cooling various components thereof, including for example the motor, the battery, and/or any other components on the marine drive assembly 12 or the motor assembly 14. In the non-limiting example shown in the drawings, the cooling system includes an open loop cooling circuit for circulating raw cooling water from the water in which the marine vessel is situated and then discharging the cooling water back to the body of water. The cooling system includes an intake inlet (not shown), which may be on the gearcase housing 26 which is connected via internal channels (not shown) to a telescoping rigid conduit 110 that extends between the drive unit 20 and a cooling water pump 112 mounted on the gimbal housing 76 outside of the marine vessel.

As best illustrated in FIG. 3, the cooling water pump 112 is coupled to a rear surface 115 of a pump motor housing 114 of the gimbal housing 76, which supports a pump motor 116 on the interior of the marine vessel. A pump motor shaft 118 extends through the rear surface 115 and is configured to drive the cooling water pump 112. The rigid conduit 110 includes a first conduit member 120 coupled to the drive unit 20 at a first swivel joint 121 and a second conduit member coupled to the cooling water pump 112 at a second swivel joint 123. The first conduit member 120 and the second conduit member 122 are slidably coupled at a telescoping joint 124. Advantageously, the telescoping joint 124 of the rigid conduit 110 allows a user to trim the drive unit 20 without disconnecting or manually adjusting the rigid conduit 110. Examples of a telescoping rigid conduit 110 are described in U.S. patent application Ser. No. 17/945,266, the entire contents of which are hereby incorporated by reference.

The cooling water pump 112 is configured to pump water from the body of water in which the marine vessel is situated to a heat exchanger 130, which is configured to exchange heat between water from the body of water and a cooling fluid for cooling a component of the marine drive assembly 12. Referring to FIGS. 3 and 4, the heat exchanger 130 is coupled to the exterior of the mounting bracket 16 such that the heat exchanger 130 is at least partially outside of the marine vessel. In particular, the illustrated heat exchanger 130 is positioned within the interior 78 of the gimbal housing 76 above the drive unit 20 and the driveshaft assembly 28 such that the heat exchanger 130 remain above the body of water during operation of the marine vessel. Positioning the heat exchanger 130 on the exterior of the marine vessel advantageously saves space within the marine vessel and allows for easy access to the heat exchanger 130 for maintenance/servicing. The heat exchanger 130 is also removably coupled to the mounting bracket 16 so that it is removable from the mounting bracket 16. This may be useful, for example in order to install, service, or replace the heat exchanger 130. Other embodiments, however, may include a heat exchanger 130 that is fixedly coupled to the mounting bracket 16. Further, the heat exchanger 130 is positioned such that at least a portion of the heat exchanger 130 is directly above a center of gravity of the marine drive assembly 12. This positioning of the heat exchanger 130 may be advantageous in that the center of gravity of the marine drive assembly 12 and the marine vessel as a whole does not shift with the removal or installation of the heat exchanger 130. Positioning the heat exchanger 130 close to the center of gravity also helps to reduce the vibrations produced by the marine drive assembly.

Figure 5:
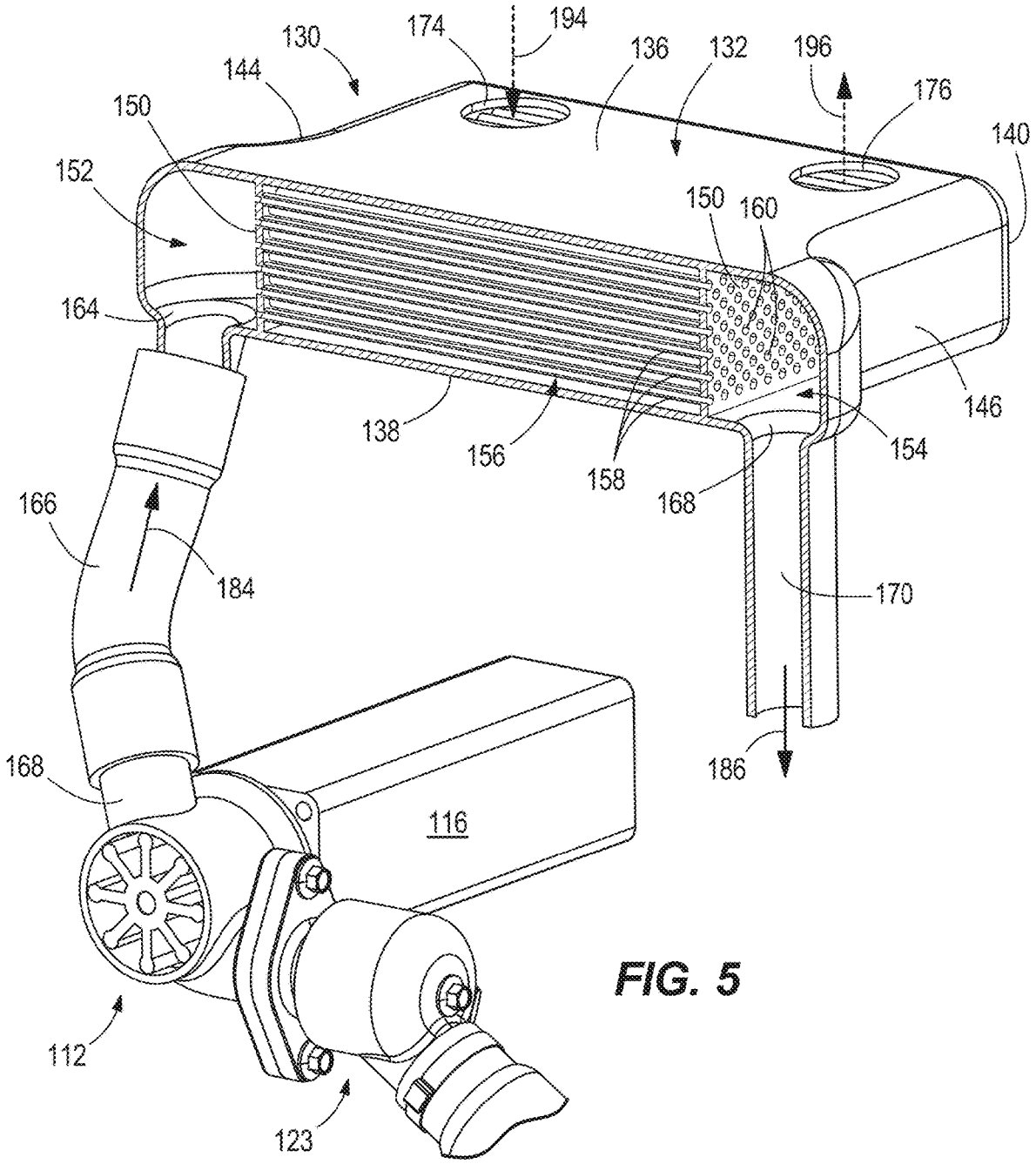
FIG. 5 is a detailed perspective view of the cooling system of FIG. 3, with a partial section of the heat exchanger.

Referring to FIG. 5, the illustrated heat exchanger 130 has a shell 132 which encloses an interior 134 of the heat exchanger 130. The shell 132 is generally prismatic and includes a top wall 136, a bottom wall 138, a front wall 140, a rear wall 142 (see FIG. 3), a port side wall 144, and a starboard side wall 146. Baffles 150 positioned within the interior 134 of the heat exchanger 130 extend between the opposing top and bottom walls 136, 138 and opposing front and rear walls 140, 142, thereby dividing the interior 134 into a first cavity 152, a second cavity 154, and a heat exchange zone 156 between the two baffles 150 and the first and second cavities 152, 154. A plurality of tubes 158 extend through the heat exchange zone 156 between opposing openings 160 formed in the baffles 150, thereby fluidly connecting the first cavity 152 to the second cavity 154 via the tubes 158. The baffles 150 seal the heat exchange zone 156 between the opposing top and bottom walls 136, 138 and opposing front and rear walls 140, 142 and the tubes 158 seal the openings 160 in the baffles, thereby fluidly disconnecting the heat exchange zone 156 from the first and second cavities 152, 154. As be described in further detail below, thermal energy is exchanged between cooling water flowing through the tubes 158 and a cooling fluid circulating through the heat exchange zone 156. In some embodiments, the heat exchanged may be configured with a different shape, size, and or orientation that that of the illustrated embodiments.

With continued reference to FIG. 5, the heat exchanger 130 includes a raw cooling water inlet 164 that is formed in the bottom wall 138 and opens into the first cavity 152. The inlet 164 is configured to receive raw water from the body of water, which is pumped into the first cavity 152 via a connecting conduit 166 that extends between the inlet 164 and a pump outlet 113 on the cooling water pump 112. An outlet 168 is formed in the bottom wall 138 and allows cooling water in the second cavity 154 to drain from the second cavity 154 after the cooling water has traveled through the tubes 158. In the illustrated embodiment, the outlet 168 includes a drain spout 170 that extends downwardly from the bottom wall 138 of the heat exchanger 130. As illustrated in FIGS. 1-3, the cooling water inlet 164 and the cooling water outlet 168 are both located outside of the marine vessel. Because the heat exchanger 130 is also located outside of the marine vessel, water pumped into the cooling system from the body of water does not enter into the marine vessel. This may be useful, for example, in order to prevent cooling water from draining or leaking into the interior of the marine vessel.

Referring to FIG. 5, a cooling fluid inlet 174 and a cooling fluid outlet 176 are formed in the top wall 136 of the heat exchanger 130. The cooling fluid inlet 174 and the cooling fluid outlet 176 both open into the interior of the heat exchange zone 156. A cooling fluid used to cool a component of the marine drive assembly 12 (e.g., the motor, the battery, the inverter, and/or any other component requiring cooling) can be pumped into and out of the heat exchange zone 156 via the inlet 174 and outlet 176, respectively. As illustrated in FIGS. 1 and 2, connectors 178, which may be rigid and/or flexible, fluidly connect the heat exchange zone 156 inlet 174 and outlet 176 to the various components to be cooled. Embodiments of a marine drive assembly 12 may use glycol, dielectric oil and/or any other suitable fluid as a cooling fluid.

When the cooling system is in operation, the pump motor 116 drives the cooling water pump 112 to draw water into the cooling system and to the heat exchanger 130. Water is drawn into the cooling system through the intake inlet on the gearcase housing 26 and up to the telescoping rigid conduit 110 via internal channels and the first swivel joint 121. The raw cooling water then travels through the rigid conduit 110 and into the cooling water pump 112 via the second swivel joint 123. Referring to FIG. 5, raw cooling water exiting the cooling water pump 112 is pumped in the direction of arrow 184 through the connecting conduit 166 and into the first cavity 152 via the cooling water inlet 164.

Once the raw cooling water has entered the heat exchanger 130, the cooling water pump 112 forces the cooling water to travel through the tubes 158 from the first cavity 152 to the second cavity 154. As cooling water travels through the heat exchange zone 156 in the tubes 158, a cooling fluid pump (not shown) pumps heated cooling fluid from the marine drive assembly 12 into the heat exchange zone 156 via the inlet 174 in the direction of arrow 194. The cooling fluid pump forces the cooling fluid to circulate within the heat exchange zone 156 before being discharged therefrom via the outlet 176 in the direction of arrow 196. While the heated cooling fluid from the marine drive assembly 12 circulates around the tubes 158, thermal energy is transferred from the hot cooling fluid to the comparatively cool cooling water that is flowing through the tubes 158. Thus, heat is transferred from the cooling fluid to the cooling water. Heated cooling water is discharged from the tubes 158 into the second cavity 154, and cooled cooling fluid is pumped back to the marine drive assembly via the outlet 176 in the direction of arrow 196.

After the heated cooling water is forced into the second cavity 154, the heated cooling water drains from the heat exchanger 130 via the cooling water outlet 168 in the direction of arrow 186. The heated cooling water is then discharged from the cooling system back into the body of water from which it was drawn. In the illustrated embodiments, the heated cooling water can drain from the heat exchanger 130 automatically under the force of gravity without requiring a discharge pump. The heat exchanger may be configured to automatically direct the cooling water to the outlet 168 under the force of gravity. For example, in some embodiments, the heat exchanger 130 may be mounted at an angle such that the cooling water naturally flows from towards the second cavity 154 and the outlet 168. Additionally or alternatively, while the illustrated bottom wall 138 of the heat exchanger 130 is generally planar, some embodiments may be configured with a bottom wall that tapers towards a drain opening.

This written description uses examples to disclose the invention, including the best mode, and to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples which occur to those skilled in the art. Such other examples are intended to be within the scope of the claims if they have features or structural elements which do not differ from the literal language of the claims, or if they include equivalent features or structural elements with insubstantial differences from the literal languages of the claims.

What is claimed is:

1. A marine drive assembly for propelling a marine vessel in a body of water, the marine drive assembly comprising:

a drive unit having a propulsor for generating a thrust force in the body of water;

a mounting bracket configured to mount the drive unit to the marine vessel, the mounting bracket having an exterior facing outside the marine vessel and an interior facing inside the marine vessel; and a heat exchanger configured to exchange heat between water from the body of water and a cooling fluid for cooling a component of the marine drive assembly, wherein the heat exchanger is coupled to the exterior of the mounting bracket and accessible from the exterior of the marine vessel for servicing.

2. The marine drive assembly according to claim 1, wherein the heat exchanger is located at least partially outside of the marine vessel.

3. The marine drive assembly according to claim 1, wherein the drive unit comprises a stern drive which extends through the mounting bracket.

4. The marine drive assembly according to claim 1, wherein the heat exchanger is located completely above the drive unit.

5. The marine drive assembly according to claim 1, wherein the heat exchanger is configured to remain completely above the body of water during operation of the marine vessel.

6. The marine drive assembly according to claim 1, wherein the heat exchanger is configured to drain the water back to the body of water automatically by gravity.

7. The marine drive assembly according to claim 1, wherein the mounting bracket comprises a gimbal housing and wherein the heat exchanger is mounted into an exterior surface of the gimbal housing.

8. The marine drive assembly according to claim 7, wherein the drive unit comprises a driveshaft assembly that extends through the gimbal housing, and wherein the heat exchanger is located completely above the driveshaft assembly.

9. The marine drive assembly according to claim 8, further comprising a cooling water pump that pumps the water from the body of water to the heat exchanger, the cooling water pump being coupled to the marine drive assembly outside of the marine vessel.

10. The marine drive assembly according to claim 1, wherein the marine drive assembly has a center of gravity and wherein the heat exchanger is located vertically directly above the center of gravity.

11. The marine drive assembly according to claim 1, further comprising a vibration isolator for coupling the mounting bracket to the marine vessel.

12. The marine drive assembly according to claim 1, wherein the heat exchanger is removable from the mounting bracket.

13. The marine drive assembly according to claim 1, wherein the heat exchanger comprises an inlet for receiving the water from the body of water and an outlet for discharging the water back to the body of water, wherein the inlet and outlet are both located outside of the marine vessel.

14. A marine vessel comprising:

a hull; and a marine drive assembly according to claim 1.

15. The marine vessel according to claim 14, wherein the drive unit comprises a stern drive that extends through the mounting bracket.

16. The marine vessel according to claim 14, wherein the heat exchanger is located entirely above the drive unit.

17. The marine vessel according to claim 14, wherein the heat exchanger is configured to remain entirely above the body of water during operation of the marine vessel.

18. The marine vessel according to claim 14, wherein the heat exchanger is configured to drain the water back to the body of water automatically by gravity.

19. A marine drive assembly for propelling a marine vessel in a body of water, the marine drive assembly comprising:

a drive unit having a propulsor for generating a thrust force in the body of water;

a mounting bracket for mounting the drive unit to the marine vessel, the mounting bracket having an exterior facing outside the marine vessel and an interior facing inside the marine vessel; and a heat exchanger configured to exchange heat between water from the body of water and a cooling fluid for cooling a component of the marine drive assembly, wherein the heat exchanger is coupled to the exterior of the mounting bracket; and a cooling water pump that pumps the water from the body of water to the heat exchanger wherein the cooling water pump is coupled to the mounting bracket outside the marine vessel.

* * * * *